United States Patent [19]

McCall et al.

[11] Patent Number: 5,000,599

[45] Date of Patent: Mar. 19, 1991

[54] WRITING IMPLEMENT

[75] Inventors: Michael L. McCall, Los Angeles, Calif.; Boyd I. Willat, 1414 N. Harper Dr., Los Angeles, Calif. 90046

[73] Assignee: Boyd I. Willat, Los Angeles, Calif.

[21] Appl. No.: 409

[22] Filed: Jan. 5, 1987

[51] Int. Cl.[5] ..... B43K 23/00

[52] U.S. Cl. ..... 401/6; 16/110 R; 401/7

[58] Field of Search ..... 401/6, 7; 81/489; 16/110 R

[56] References Cited

U.S. PATENT DOCUMENTS

| | | | |
|---|---|---|---|
| 141,287 | 7/1873 | Orndorff . | |
| 255,961 | 4/1882 | Faber . | |
| 412,479 | 10/1889 | Davis | 401/6 X |
| 544,990 | 8/1895 | Miller . | |
| 624,853 | 5/1899 | Oberbeck . | |
| 770,363 | 9/1904 | Goldsmith . | |
| 782,388 | 2/1905 | Goldsmith . | |
| 839,537 | 12/1906 | Beaumel . | |
| 1,868,441 | 7/1932 | Colfelt . | |
| 2,236,194 | 3/1941 | Lorber . | |
| 3,269,399 | 8/1966 | Smith | 16/110 R |
| 4,035,089 | 7/1977 | Schwartz et al. . | |
| 4,167,347 | 9/1979 | Hoyle . | |

FOREIGN PATENT DOCUMENTS

| | | | |
|---|---|---|---|
| 1511325 | 7/1969 | Fed. Rep. of Germany | 401/6 |
| 2157175 | 5/1973 | Fed. Rep. of Germany | 401/6 |
| 2162132 | 6/1973 | Fed. Rep. of Germany | 401/6 |
| 3406522 | 9/1985 | Fed. Rep. of Germany | 401/6 |

*Primary Examiner*—Steven A. Bratlie

*Attorney, Agent, or Firm*—Kelly Bauersfeld & Lowry

[57] ABSTRACT

A writing implement or the like is provided with a deformable grip for shape conformance in accordance with anatomical contours of the individual user, thereby providing enhanced user comfort with minimum fatigue during use. The deformable grip is located on the body of a writing implement in a position for grasping with the user's fingertips during normal use of the writing implement. The deformable grip is adapted to undergo substantial localized deformation in response to light manual pressure applied by the user's fingertips to conform geometrically with the shape of the user's fingertips in a custom fit manner, thereby providing a highly comfortable grip with a unique, novelty feel. The deformable grip is further adapted for retention of the deformed geometry for at least a substantial period of time, for example, at least about five seconds or more.

9 Claims, 2 Drawing Sheets

FIG. 1
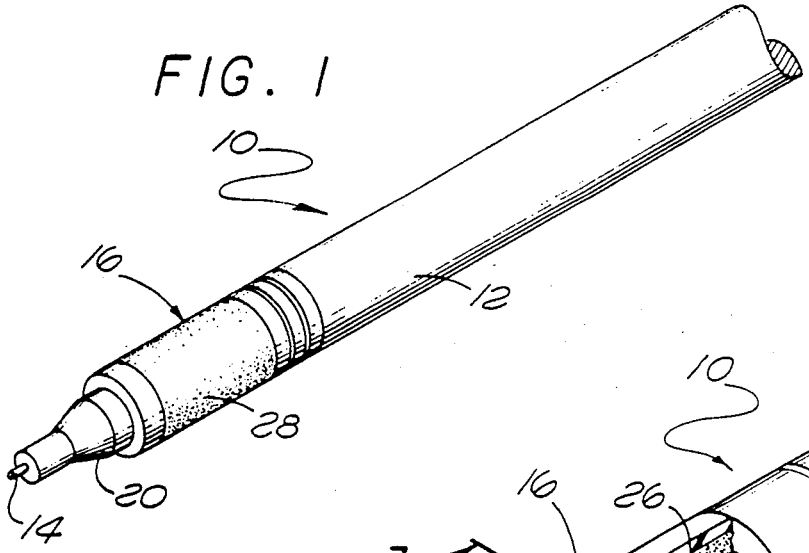
FIG. 2
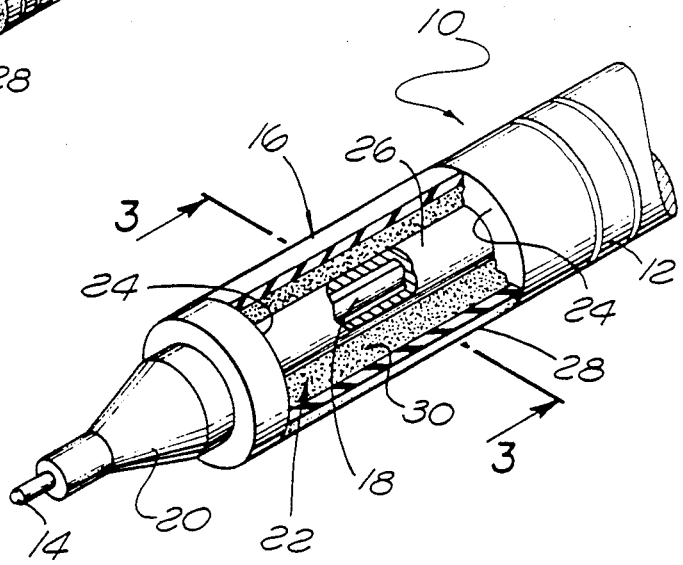
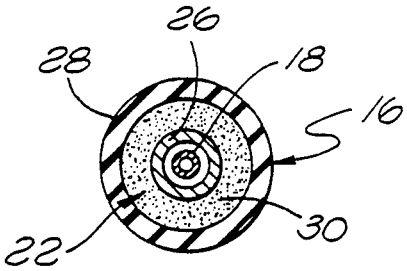
FIG. 3
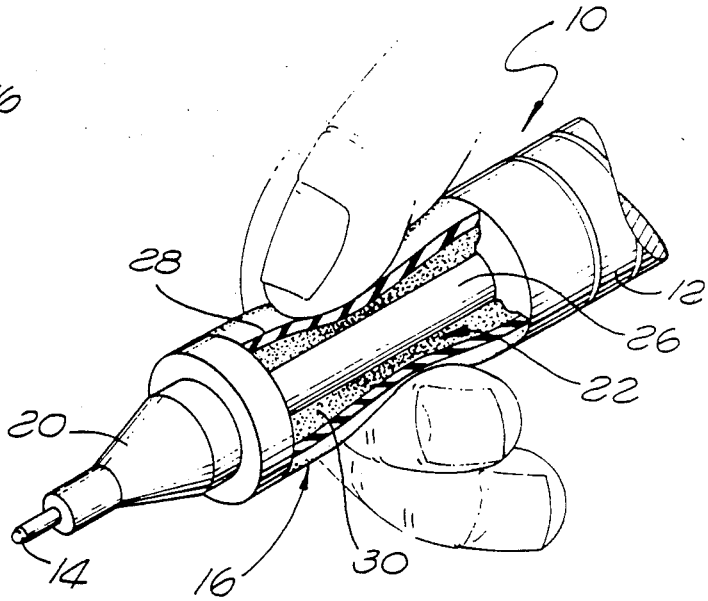
FIG. 4

WRITING IMPLEMENT

BACKGROUND OF THE INVENTION

This invention relates generally to improvements in writing implements of the general type including ink pens, pencils, felt tip markers, and other types of writing implements. More specifically, this invention relates to an improved writing implement having a deformable grip responsive to user fingertip pressure to assume a highly comfortable and low fatigue geometric configuration.

A wide variety of different kinds of writing implements are well known to include many different types of ink pens, pencils, and various other forms of marking implements. Such writing implements typically comprise a generally cylindrical or barrellike elongated body carrying a marking medium, for example, a ball point pen cartridge having a porous ball writing tip exposed at the end of a long and thin ink-containing cylinder. The implement body is traditionally grasped by the fingertips at a position near the writing tip to facilitate implement manipulation during movement of the writing tip over the surface of a marking medium such as paper or the like.

The generally cylindrical body of a writing implement may be formed in a wide variety of different sizes and specific geometric shapes. In this regard, it is generally recognized that the size and shape of most writing implements is not adapted for prolonged use without experiencing a relatively high degree of user fatigue and discomfort, sometimes referred to as writer's cramp. In attempts to alleviate this situation, many writing implements are provided with contoured grip surfaces of many different sizes and shapes, with some of such contoured grip surfaces constituting complex molded surfaces aimed at approximating the anatomical contours of a writer's fingertips during grasping of the writing implement. However, these grip surface configurations have achieved only limited success in relieving writer's fatigue since, among other reasons, the grip surface is unable to match the differing anatomical shapes and pen grasping techniques of different individuals.

Some writing implements have been provided with resilient grip surfaces as an alternative approach to achieving enhanced comfort and reduced fatigue during use. For the most part, these resilient grip surfaces include sleevelike structures mounted about the body of a writing implement to provide a cushioned grip surface with at least some yield in response to fingertip pressure when the writing implement is gripped. In some cases, air chambers have been proposed between the resilient sleeve and the implement body for increased overall cushioning effect. However, while this approach may achieve some improvements in user comfort, the resilient sleeve is unable to undergo significant shape change when gripped, whereby the sleeve cannot accommodate a truly customized geometry tailored to the individual user. The resilient nature of the sleeve results in reaction forces applied to the user's fingertips urging the sleeve to spring substantially immediately back toward a relaxed or nondeformed state, wherein these reaction forces can themselves contribute to writer's fatigue over a prolonged period of time.

There exists, therefore, a need for further improvements in writing implements, particularly with respect to an improved writing implement designed to achieve significant enhancements in user comfort and reductions in user fatigue. The present invention fulfills these needs and provides further related advantages.

SUMMARY OF THE INVENTION

In accordance with the invention, an improved writing implement is provided with a soft, deformable grip for shape adaptation in conformance with the user's fingertips during use. The deformable grip assumes a custom fit configuration when gripped for enhanced user comfort and reduced fatigue. Importantly, upon deformation, the deformable grip retains the custom fit configuration for a substantial period of time.

In accordance with a preferred form of the invention, the writing implement includes an elongated body carrying a marking medium such as a ball point pen cartridge or the like, with said medium having an exposed writing tip protruding from one end of the implement body for marking engagement with paper or the like. The deformable grip is carried by the implement generally at or near the end adjacent the projecting marking medium tip for fingertip grasping when the writing implement is used in a normal manner. In the preferred form, the implement body is configured to include a recessed annular cavity which is circumferentially enclosed by a resilient sleeve, with a deformable yet relatively material such as a deformable putty carried within the cavity. Upon fingertip grasping during use of the writing implement, the resilient sleeve is pressed against the deformable putty material to reshape the deformable grip in accordance with custom fit anatomical contours.

In accordance with one aspect of the invention, the deformable putty viscous material is adapted to retain the deformed shape, whereby the grip can be released and regripped by the same user without undergoing significant shape change. In a preferred form, the putty material has a relatively high degree of elasticity yet relatively slow recovery time or speed of retraction upon deformation, such that the deformable grip will retain its deformed configuration after release for at least a substantial period of at least five seconds or more. After that time period, however, the deformable grip will slowly return substantially to its initial nondeformed shape and can later be regripped by a second user with appropriate reshaping to an alternative configuration.

In accordance with alternative further aspects of the invention, the deformable putty material within the recessed cavity may be provided, for example, from a curable substance to permit initial deformation from a generally cylindrical shape to a custom fit shape, followed by material curing to a relatively nondeformable set. In this version, the cured material will thus maintain indefinitely the unique shape characteristics for a specific individual user.

In another alternative form of the invention, the deformable grip may be defined by a generally cylindrical extrusion having resilient outer and inner concentric sleeve components interconnected by a plurality of radially oriented vented webs defining a plurality of chambers in communication with each other. These chambers contain a flowable yet relatively viscous substance which displaces through vent openings in the webs to permit the overall extrusion to assume different geometries in response to fingertip pressure applied by the user. The deformed geometry is retained after release of the grip, due to the vent openings permitting only a relatively slow material return to equilibrium condition within the chambers.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 fragmented perspective view illustrating an improved writing implement embodying the novel features of the invention;

FIG. 2 is an enlarged fragmented perspective view illustrating a portion of the writing implement of FIG. 1;

FIG. 3 is an enlarged cross sectional view taken generally on the line 3—3 of FIG. 2;

FIG. 4 is an enlarged fragmented perspective similar to FIG. 2 but illustrating shape adaptation of a deformable grip in response to fingertip pressure;

DETAILED DESCRIPTION OF THE PREFERRED EMBODIMENTS

Figure 5:
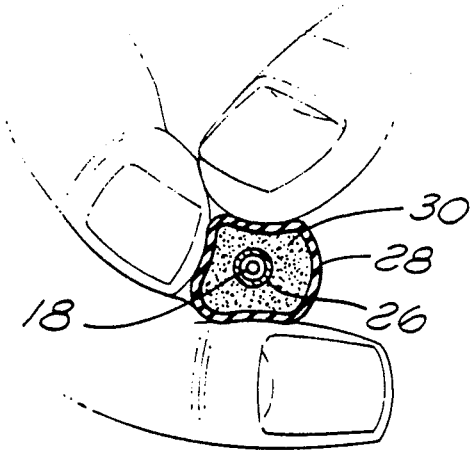
FIG. 5 is a cross sectional view similar to FIG. 3 but illustrating application of fingertip pressure to the deformable grip during use of the writing implement.

As shown in the exemplary drawings, an improved writing implement is referred to generally in FIG. 1 by the reference numeral 10. The writing implement 10 includes an elongated implement body 12 carrying a marking medium with a marking tip 14 exposed at one end of the implement body. A deformable grip 16 is provided on the implement body 12 generally at or near the end adjacent the writing tip 14, wherein this deformable grip 16 conforms geometrically to the anatomical contours of a particular user's fingertips (not shown in FIG. 1).

The improved writing implement 10 of the present invention is designed for significantly enhanced writer comfort with minimum writer fatigue, thereby providing a unique feel and permitting comfortable use of the writing implement 10 over a prolonged period of time, if desired. Moreover, this enhanced writer comfort further provides for increased manipulative capability resulting, for many writers, in improved writing skills with greater marking precision and improved writing clarity. The deformable grip 16 advantageously conforms in a unique, completely custom or personalized fit manner with the exact shape of the writer's fingertips, irrespective of the manner in which the implement 10 is gripped, thereby providing utility for virtually any writer.

The improved writing implement 10 is shown in FIGS. 1–5 in one preferred form as embodied in a ball point pen marking implement. More particularly, as shown in these illustrative drawings, the implement body 12 has an elongated and generally cylindrical configuration with a hollow interior for receiving and supporting a marking medium 18 shown in the form of a standard ball point pen cartridge. The front end of this marking medium 18 protrudes through a head 20 at one end of the implement body 12 and terminates in the exposed writing tip 14, namely, a floating porous ball through which ink (not shown) within the elongated cartridge 18 can flow when applied to a writing surface such as paper or the like. Alternately, it should be understood that the depiction of a ball point implement is for illustrative purposes only; the deformable grip 16 may be applied to any of a wide range of different types of pens, pencils, and other types of writing implements, as well as other manual implements with working tips, for example, paint brushes, jeweler's tools, and other devices. Moreover, it will be understood that the physical size, shape and particular cross sectional geometry of the implement body 12 can be varied as desired.

As shown in more detail in FIGS. 2–5, the writing implement body 12 is shaped to include a generally annular recessed cavity 22 at a position at or near the head 20. This recessed cavity 22 is, in the preferred form, defined between axially spaced shoulders 24 and surrounds a central guide tube 26 of reduced diameter, through which the marking medium cartridge 18 extends. The axial length of this recessed cavity 22 may vary in accordance with the size and style of the writing implement with an axial length on the order of about one to two inches being suitable for most applications. Alternately, if desired, the cavity may extend for elongated portions of the implement body 12.

The recessed cavity 22 is enclosed by a cylindrical sleeve 28 of a thin rubber-based or deformable plastic or other selected elastomer material. A deformable medium such as a relatively viscous putty substance 30 is contained within the cavity 22 beneath the sleeve 28 for accommodating fingertip pressure induced shape deformation of the sleeve 28 during normal use of the writing implement. A preferred deformable medium 30 includes, for example, vinyl elastomers and/or silicone-based substances, with the putty material marketed by Dow Chemical Corporation of Midland, MI under the name Silly Putty being especially well suited to this environment. Such putty material advantageous conforms relatively easily upon light fingertip pressure during normal gripping of the implement, as viewed in FIGS. 4 and 5, and maintains its deformed shape for a substantial period of time after release. The referenced Silly Putty material has relatively excellent elasticity but with slow recovery time, such that the released grip will maintain its deformed shape for at least about five seconds and then return slowly over the next ten or fifteen seconds nearly to the initial nondeformed state. The grip can then be grasped by a different user for deformation to a different customized shape.

In accordance with one alternative form of the invention, the deformable substance 30 within the cavity 22 may be constituted by a curable substance for assuming a relatively nondeformable geometry after initial deformation to the customized contour. Such curable substances include, for example, room temperature curable silicone-based substances or the like which can be activated by heat, exposure to air, or other suitable means upon initial deformation. Such materials will provide a comfortable cushioned grip which substantially maintains its customized shape for the individual user.

Figure 6:
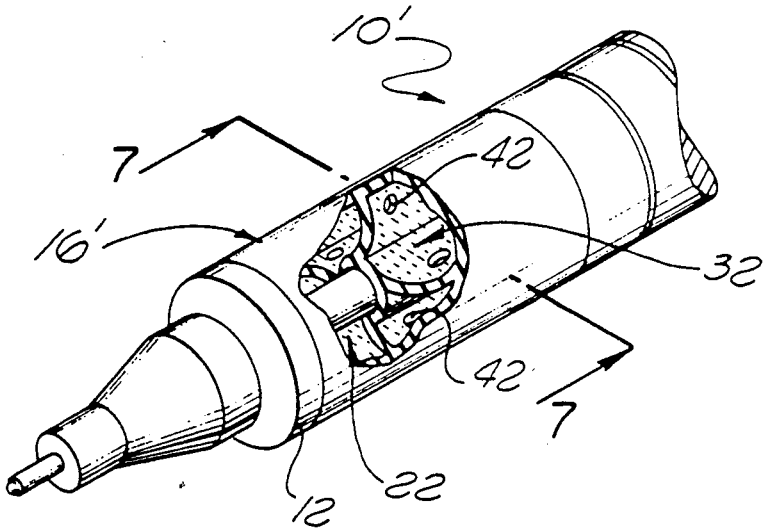
FIG. 6 is a fragmented perspective view illustrating an alternative preferred form of the invention.
Figure 7:
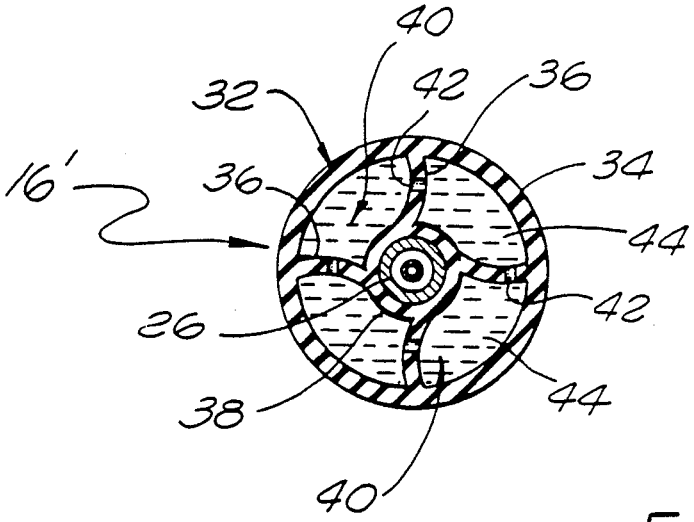
FIG. 7 is an enlarged cross sectional view taken generally on the line 7—7 of FIG. 6.

In accordance with a further alternative form of the invention, as viewed in FIGS. 6 and 7, a modified writing implement 10' is provided with an alternative grip 16' for deformation upon normal gripping for use. In this embodiment, the grip 16' is defined by an extrusion 32 may be provided for installation into the recessed cavity 22 of an implement body 12, wherein the extrusion 32 defines an outer resilient sleeve component 34 molded integrally with interior radially extending webs 36. These webs 36 are joined in turn at their radially innermost ends with a smaller diameter inner sleeve component 38 adapted for relatively snug fit about the central tube 26 within the recessed cavity 22. The inner and outer sleeve components 34 and 38 of the extrusion 32 cooperate with the webs 36 to define a plurality of radially spaced chambers 40 which intercommunicate with each other through small vent openings 42 in the webs 36. While the illustrative drawings show a number of webs 36 to define four generally identical chambers 40, it will be understood that any plurality of such chambers may be provided and further that the relative sizes of the chambers may be varied, if desired.

The chambers 40 defined by the extrusion 32 are adapted to receive and contain a flowable substance 44 of relatively viscous physical characteristics, such as a silicone-based grease or other lubricant or similar viscous substance such as, for example, a viscous sealant and lubricant marketed under the name Magic Lube by Aladdin Equipment Company of Huntington Beach, CA. With this construction, when the writing implement 10' is grasped for normal writing use, the writer's fingertips apply light manual pressure to the outer sleeve component 34 to cause the flowable material 44 to express through the vent openings 42 in a manner allowing the extrusion 32 to assume a revised shape in close conformance with the contours of the user's fingertips. Once the contoured geometric shape is achieved, however, the vent openings 42 tend to restrict rapid return of the flowable substance through the openings toward a balanced or equilibrium condition within the chambers, whereby the grip 16' tends to retain the contoured shape for a substantial time period. Once the grip is released for a significant time period, however, the flowable substance will eventually return through the vent openings 42 to an equilibrium condition within the chambers, as a result of elastic forces applied by the resilient nature of the extrusion, to permit gripping and shaping by a different user to assume a different customized geometry.

The improved writing implement of the present invention thus provides an easily deformable grip which will adapt uniquely in a custom fit manner to the fingertip shape of a individual user. This results in a unique or novelty feel while further providing significant enhancements in writer comfort during use and a corresponding reduction in writer fatigue. Reduced writer fatigue is particularly avoided due to the absence of immediate springing back of the grip to its initial shape, and the corresponding absence of reaction forces related thereto.

A variety of further modifications and improvements to the present invention are believed to apparent to those skilled in the art. For example, instead of permanently mounting the deformable grip on the body of a writing implement, the grip can be adapted as an enlarged sleeve defining a bladder with the deformable substance therein, said sleeve being removably mountable onto any selected implement. Accordingly, no limitations on the present invention are intended by way of the accompanying description and drawings, except as set forth in the appended claims.

What is claimed is:

1. A writing implement, comprising:

an implement body;

a marking medium carried by said implement body and including a writing tip; and a deformable grip on said implement body in a position for manual grasping by a writer during use of said writing implement, said grip including means responsive to said manual grasping for changing the shape of said grip from an initial shape to a custom fit shape conforming substantially with the anatomical coutours of the writer's fingertips for enhanced comfort and reduced fatigue during use of the writing implement, said shape changing means retaining said custom fit shape for at least about five seconds following release of said grip by the writer and thereafter returning substantially to said initial shape.

2. The writing implement of claim 1 wherein said grip comprises a resilient outer sleeve component about said implement body, and a relatively viscous material interposed between said outer sleeve component and said implement body.

3. The writing implement of claim 2 wherein said relatively viscous material comprises a putty material.

4. The writing implement of claim 3 wherein said putty material comprises a vinyl elastomer putty material.

5. The writing implement of claim 1 wherein said marking medium projects from one end of said implement body, said implement body having a recessed cavity formed therein at a position generally adjacent said one end thereof, and said grip comprising a relatively viscous material disposed within said recessed cavity and a generally cylindrical and resilient outer sleeve circumferentially surrounding said cavity to enclose said viscous material within said cavity.

6. The writing implement of claim 5 wherein said grip further includes an extrusion formed from a resilient material, said extrusion having said outer sleeve formed integrally therewith and further including means for mounting onto said body within said cavity, and further including means forming a plurality of intercommunicating chambers encircled by said outer sleeve, said relatively viscous material comprising a flowable substance within said chambers.

7. The writing implement of claim 1 wherein said writing tip projects from one end of said body, said body having formed therein a recessed cavity near said one end, said grip comprising a unitary extrusion having inner and outer generally concentric sleeve components interconnected by a plurality of generally radially oriented webs having vent openings formed therein, said inner sleeve component being received about said body within said recess, said outer sleeve component cooperating with said inner sleeve component and said webs to define a plurality of intercommunicating chambers, and further including a flowable substance within said chambers to accommodate shape change of said extrusion upon manual grasping of said outer sleeve component with said flowable substance flowing through said vent openings in response to such manual grasping, said vent openings restricting passage of said flowable substance sufficiently to prevent rapid shape change of said extrusion.

8. A manual implement, comprising:

an implement body; and a deformable grip on said implement body in a position for manual grasping by a user during use of said implement, said grip including means responsive to said manual grasping for changing the shape of said grip from an initial shape to a custom fit shape conforming substantially with the anatomical contours of the user's hand for enhanced comfort and reduced fatigue, said shape changing means retaining said custom fit shape for at least a substantial period of time of at least about five seconds after release of said grip and thereafter returning substantially to said initial shape.

9. A writing implement, comprising:

an elongated implement body;

a marking medium carried by said implement body and having a writing tip projecting from one end of said implement body;

said implement body having a reduced cross sectional portion generally near said one end and defining a recessed cavity relative to the remainder of said body; and a deformable grip mounted generally within said recessed cavity, said deformable grip including an outer sleeve for manual grasping by a writer's fingertips during use of said implement, and means interposed between said sleeve and said reduced cross sectional portion for deforming in response to manual pressure during manual grasping of said sleeve to permit reshaping of said grip from an initial shape to a custom fit shape generally conforming to the configuration of the writer's fingertips, said means retaining said custom fit shape for at least five seconds after release of said grip and thereafter returning substantially to said initial shape.

* * * * *